US009995292B2

(12) United States Patent
Liao et al.

(10) Patent No.: US 9,995,292 B2
(45) Date of Patent: Jun. 12, 2018

(54) PUMPING DEVICE

(71) Applicants: Ying-Chieh Liao, Taichung (TW); Yu-Kuo Liao, Taichung (TW)

(72) Inventors: Ying-Chieh Liao, Taichung (TW); Yu-Kuo Liao, Taichung (TW)

( * ) Notice: Subject to any disclaimer, the term of this patent is extended or adjusted under 35 U.S.C. 154(b) by 259 days.

(21) Appl. No.: 14/859,761

(22) Filed: Sep. 21, 2015

(65) Prior Publication Data

US 2017/0082095 A1 Mar. 23, 2017

(51) Int. Cl.

| | |
|---|---|
| ***F04B 23/02*** | (2006.01) |
| ***F04B 9/14*** | (2006.01) |
| ***F04B 53/14*** | (2006.01) |
| ***F04B 53/16*** | (2006.01) |
| ***F04B 17/06*** | (2006.01) |

(52) U.S. Cl.

CPC ..... *F04B 23/028* (2013.01); *F04B 9/14* (2013.01); *F04B 17/06* (2013.01); *F04B 23/025* (2013.01); *F04B 53/144* (2013.01); *F04B 53/16* (2013.01)

(58) Field of Classification Search

CPC ..... F04B 9/14; F04B 17/06; F04B 23/025; F04B 23/026; F04B 23/028; F04B 53/144; F04B 53/16

USPC ..... 137/205

See application file for complete search history.

(56) References Cited

U.S. PATENT DOCUMENTS 6,474,443 B2 * 11/2002 Kearns ..... F01M 11/045 137/205
2007/0253846 A1 * 11/2007 Bakker ..... F04B 9/14 417/437
2017/0045045 A1 * 2/2017 Tseng ..... F04B 45/02

FOREIGN PATENT DOCUMENTS

TW M286894 U 2/2006

* cited by examiner

*Primary Examiner* — Dominick L Plakkoottam
*Assistant Examiner* — Chirag Jariwala
(74) *Attorney, Agent, or Firm* — Muncy, Geissler, Olds & Lowe, P.C.

(57) ABSTRACT

A pumping unit is operable between sucking and discharging states. The main body has a sucking channel, a discharging channel and at least one blocking mechanism. The sucking channel communicates with outside and an interior of the pumping unit, the discharging channel communicates with a receiving space of a receiving unit and the interior of the pumping unit, and one said blocking mechanism is arranged within the sucking channel to block the sucking channel selectively. Wherein, when the pumping unit is in the sucking state, the blocking mechanism unblocks the sucking channel, and the fluid enters the interior of the pumping unit; when the pumping unit is in the discharging state, the blocking mechanism blocks the sucking channel, and the fluid enters the receiving space. A pumping device is further provided for sucking a fluid from the receiving space and discharging the fluid to outside.

9 Claims, 8 Drawing Sheets

PUMPING DEVICE

BACKGROUND OF THE INVENTION

Field of the Invention

The present invention relates to a pumping device.

Description of the Prior Art

In a conventional pump, a piston is pulled via a pumping rod to suck a fluid from an opening of the pump, the pump is then taken to other places, and then the pumping rod is pushed so as to push the piston to discharge the fluid out of the pump. It is inconvenient to operate the pump, and the fluid may leak during the process of moving the pump. Therefore, an improved pump as disclosed in TWM286894 sucks and discharges the fluid through positional difference of an inner tube and an outer tube or positional difference of an inlet opening and an outlet opening.

However, this type of pump has a complicated structure. Positions of members need to correspond to one another precisely, so it is difficult to assemble the pump. In addition, this type of pump is great in weight and volume, so the pump cannot be carried around and cannot be used when tilted.

The present invention has arisen to mitigate and/or obviate the afore-described disadvantages.

SUMMARY OF THE INVENTION

The major object of the present invention is to provide a pumping device, which has a simpler design and is time-saving to be assembled and produced; and a volume of the pumping device is smaller, so it is convenient for a user to carry the pumping device around. In addition, with a storage barrel, it is convenient to carry a fluid stored in the storage barrel to other places.

To achieve the above and other objects, a pumping device is provided, including a pumping unit, a receiving unit and a main body. The pumping unit is provided for being operated from outside to switch between a sucking state and a discharging state. The receiving unit has a receiving space. The main body has a sucking channel for a fluid to enter thereinto, a discharging channel and at least one blocking mechanism. The sucking channel communicates with outside and an interior of the pumping unit, the discharging channel communicates with the receiving space and the interior of the pumping device, and one of the at least one blocking mechanism is arranged within the sucking channel to block the sucking channel selectively. Wherein, when the pumping unit is in the sucking state, the blocking mechanism unblocks the sucking channel, and the fluid enters the interior of the pumping unit; when the pumping unit is in the discharging state, the blocking mechanism blocks the sucking channel, and the fluid enters the receiving space.

To achieve the above and other objects, a pumping device is further provided, including a pumping unit, a receiving unit and a main body. The pumping unit is provided for being operated from outside to switch between a sucking state and a discharging state. The receiving unit has a receiving space for storing a fluid. The main body has a sucking channel, a discharging channel and at least one blocking mechanism. The sucking channel communicates with the receiving space and the interior of the pumping unit, the discharging channel communicates with outside and the interior of the pumping unit, and one of the at least one blocking mechanism is arranged within the sucking channel to block the sucking channel selectively. Wherein, when the pumping unit is in the sucking state, the blocking mechanism unblocks the sucking channel, and the fluid enters the interior of the pumping unit; when the pumping unit is in the discharging state, the blocking mechanism blocks the sucking channel, and the fluid flows to outside.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
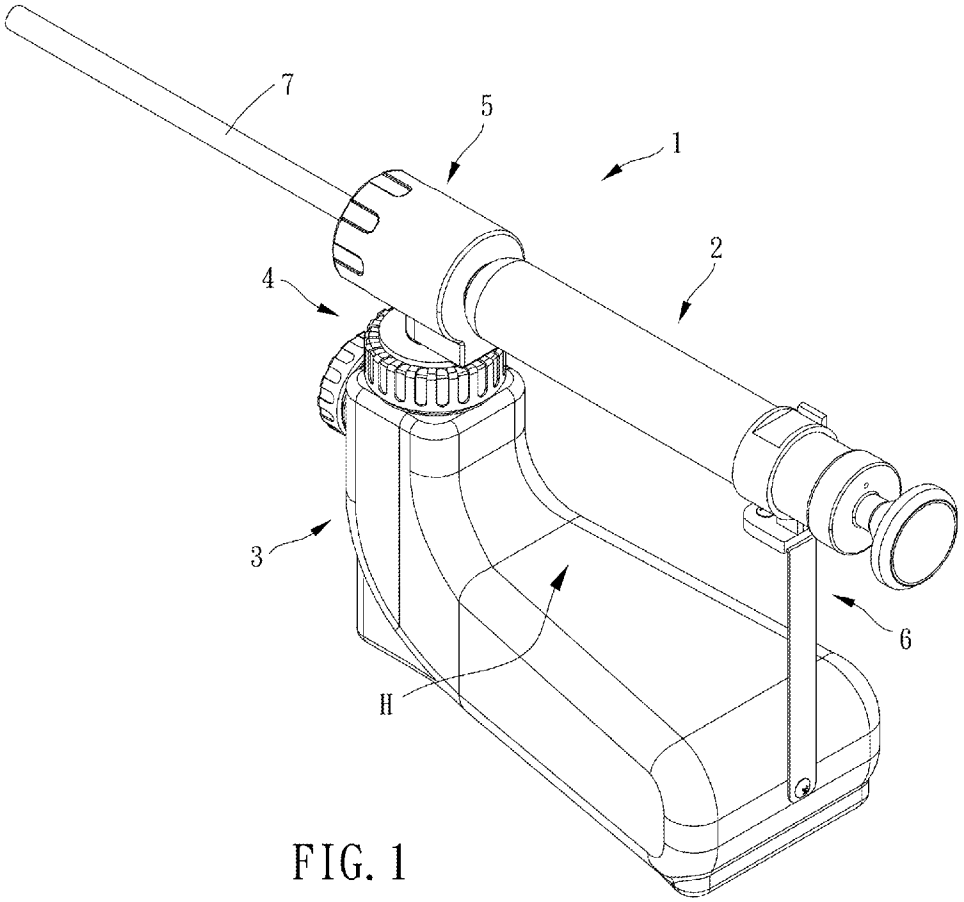
FIG. 1 is a sketch of a first preferred embodiment of the present invention.
Figure 2:
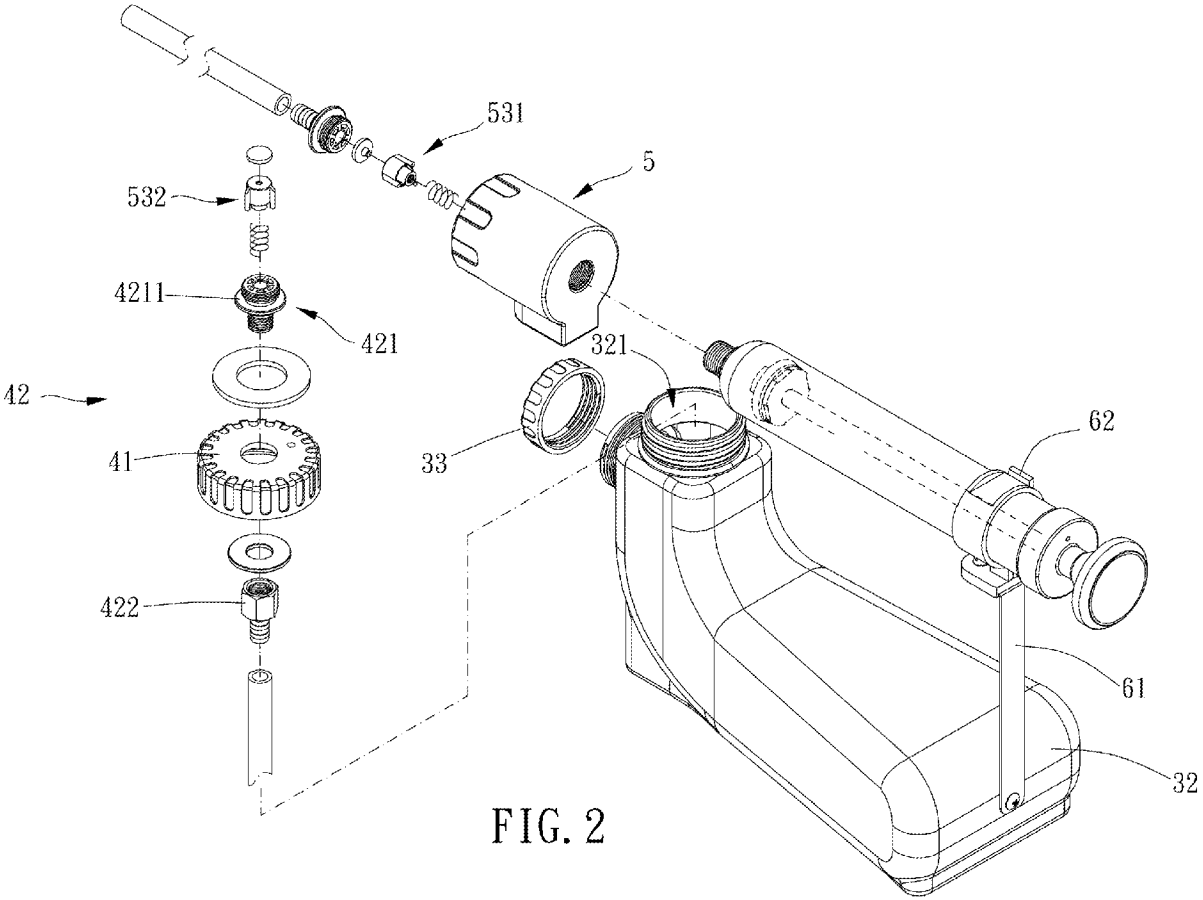
FIG. 2 is a breakdown drawing of the first preferred embodiment of the present invention.
Figure 3:
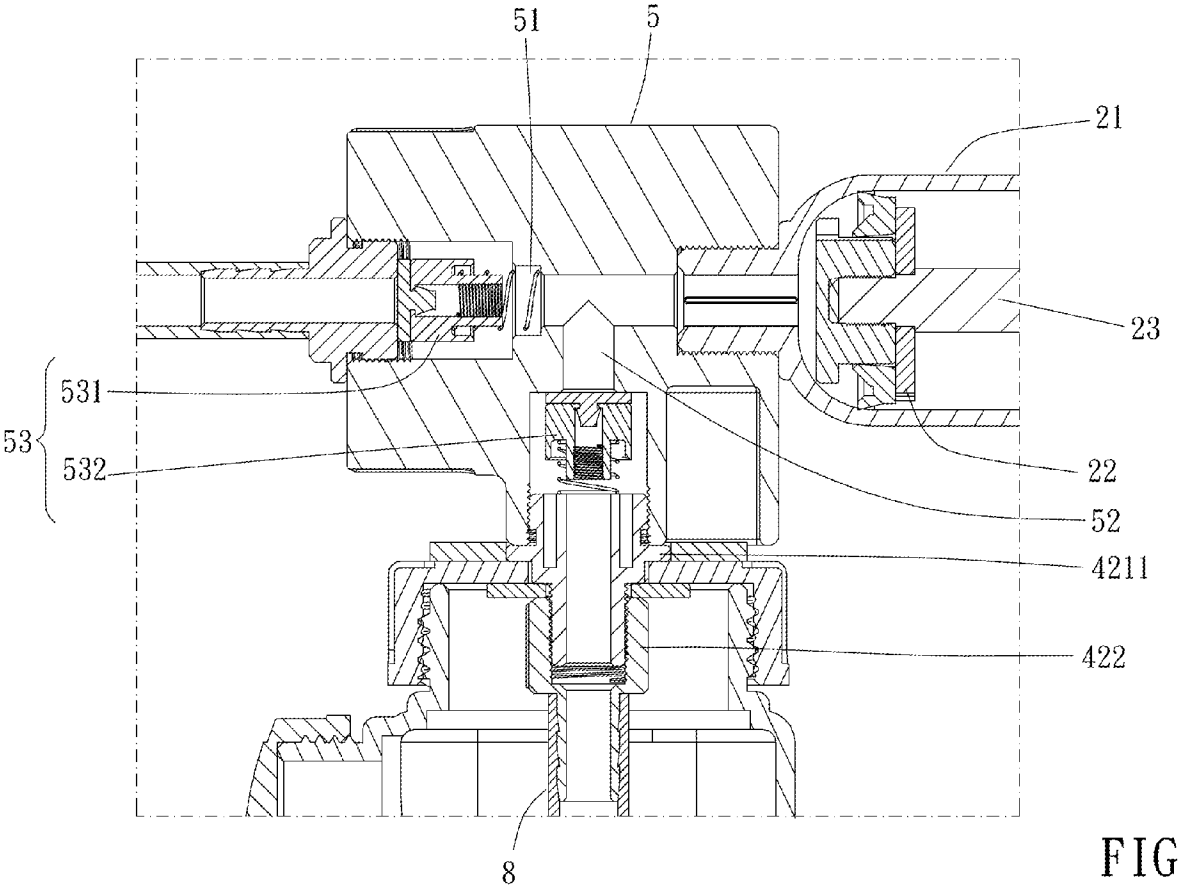
FIG. 3 is a partial cross-sectional drawing of the first preferred embodiment of the present invention.
Figure 4:
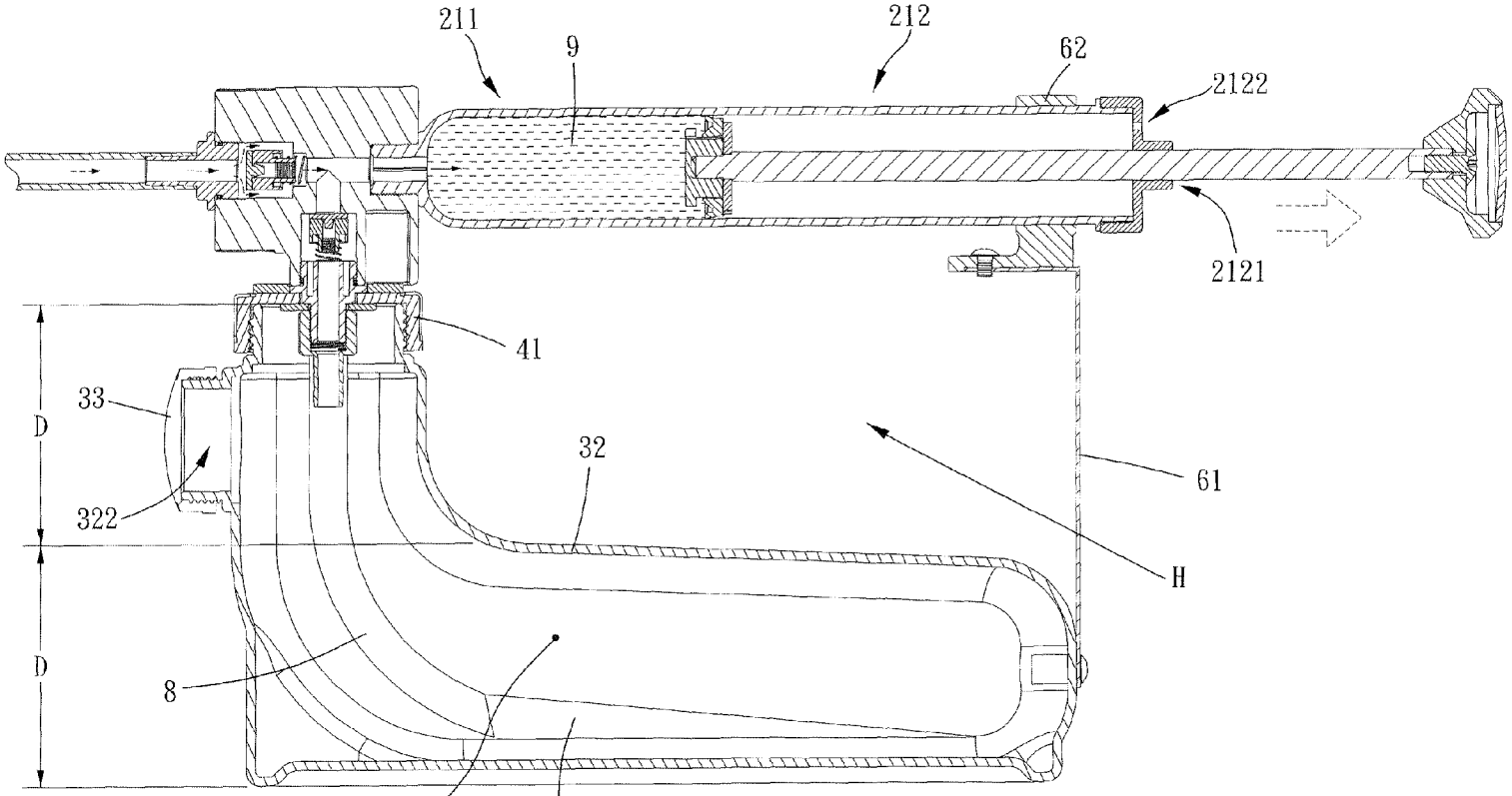
FIGS. 4 and 5 are drawings showing the first preferred embodiment of the present invention in use.
Figure 5:
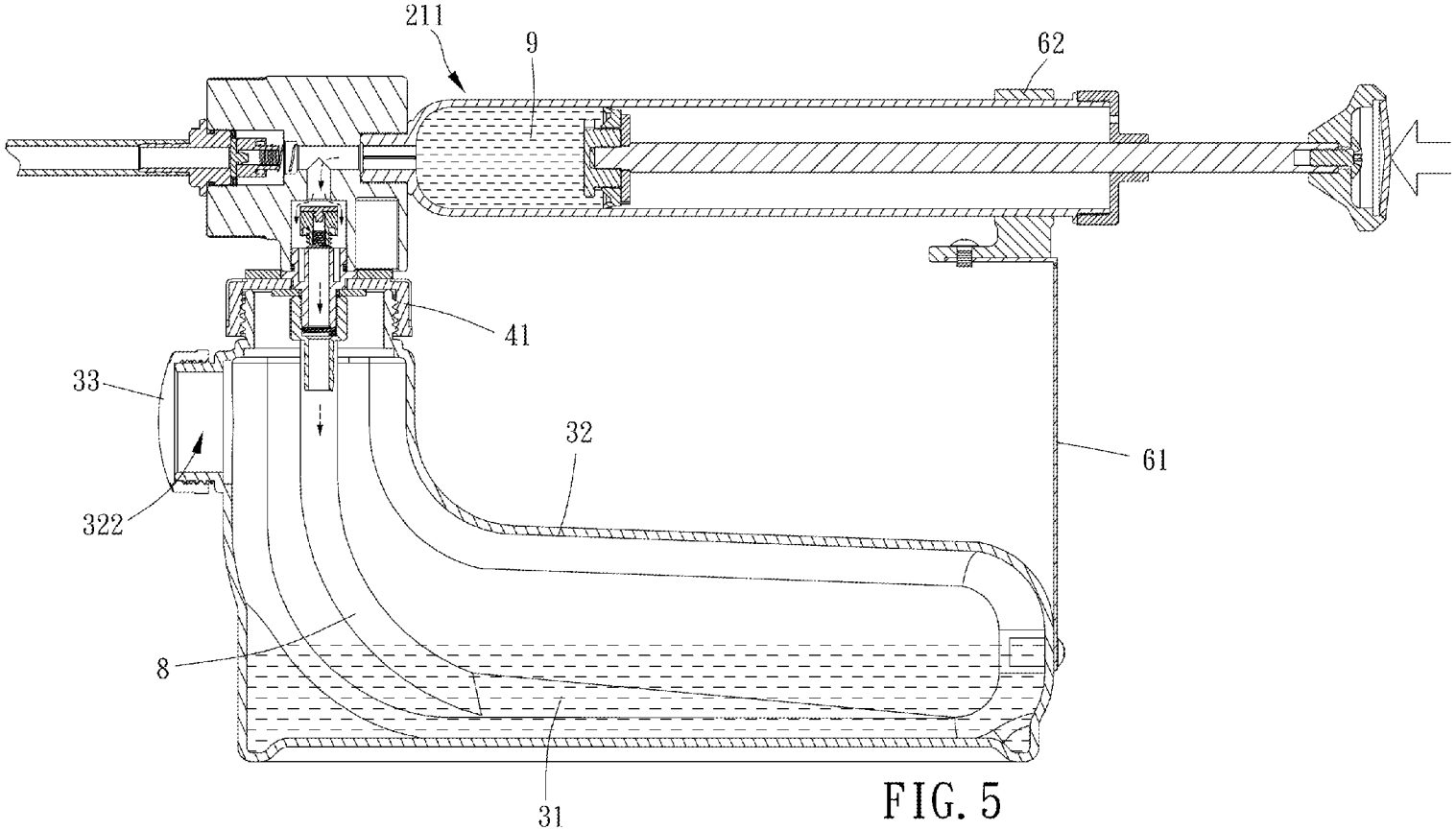

The present invention will be clearer from the following description when viewed together with the accompanying drawings, which show, for purpose of illustrations only, the preferred embodiment in accordance with the present invention.

Please refer to FIGS. 1 to 5 for a first preferred embodiment of the present invention. A pumping device 1 includes a pumping unit 2, a receiving unit 3 and a main body 5.

The pumping unit 2 is provided for being operated from outside to switch between a sucking state and a discharging state. The receiving unit 3 has a receiving space 31. The main body 5 has a sucking channel 51 for a fluid 9 to enter thereinto, a discharging channel 52 and at least one blocking mechanism 53. The sucking channel 51 communicates with outside and an interior of the pumping unit 2, the discharging channel 52 communicates with the receiving space 31 and the interior of the pumping unit 2, and one of the at least one blocking mechanism 53 is arranged within the sucking channel 51 to block the sucking channel 51 selectively. Wherein, when the pumping unit 2 is in the sucking state, the blocking mechanism 53 unblocks the sucking channel 51, and the fluid 9 enters the interior of the pumping unit 2; when the pumping unit 2 is in the discharging state, the blocking mechanism 53 blocks the sucking channel 51, and the fluid 9 enters the receiving space 31.

Preferably, the main body 5 has two said blocking mechanisms 53 to respectively restrain flow directions of the sucking channel 51 and the discharging channel 52. In the first embodiment, the two blocking mechanisms 53 are respectively a first unidirectional valve 531 arranged in the sucking channel 51 and a second unidirectional valve 532 arranged in the discharging channel 52. The first unidirectional valve 531 is only communicable from the sucking channel 51 toward the pumping unit 2, and the second unidirectional valve 532 is only communicable from the pumping unit 2 toward the receiving space 31. The first and second unidirectional valves 531, 532 can make sure that the fluid 9 moves in a preset path so as to effectively prevent the fluid 9 from flowing reversely. In addition, a structure of the pumping device 1 can be simpler.

Figure 6:
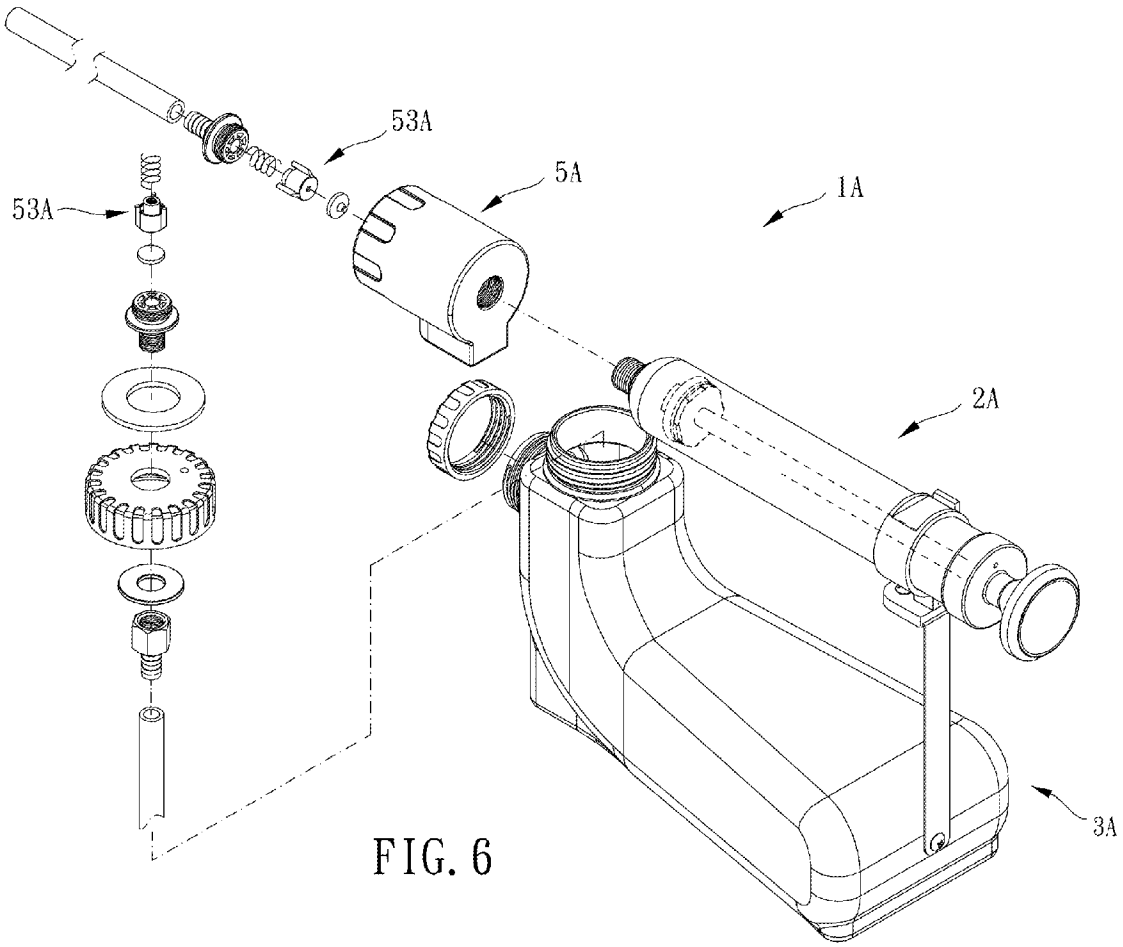
FIG. 6 is a sketch of a second preferred embodiment of the present invention.
Figure 7:
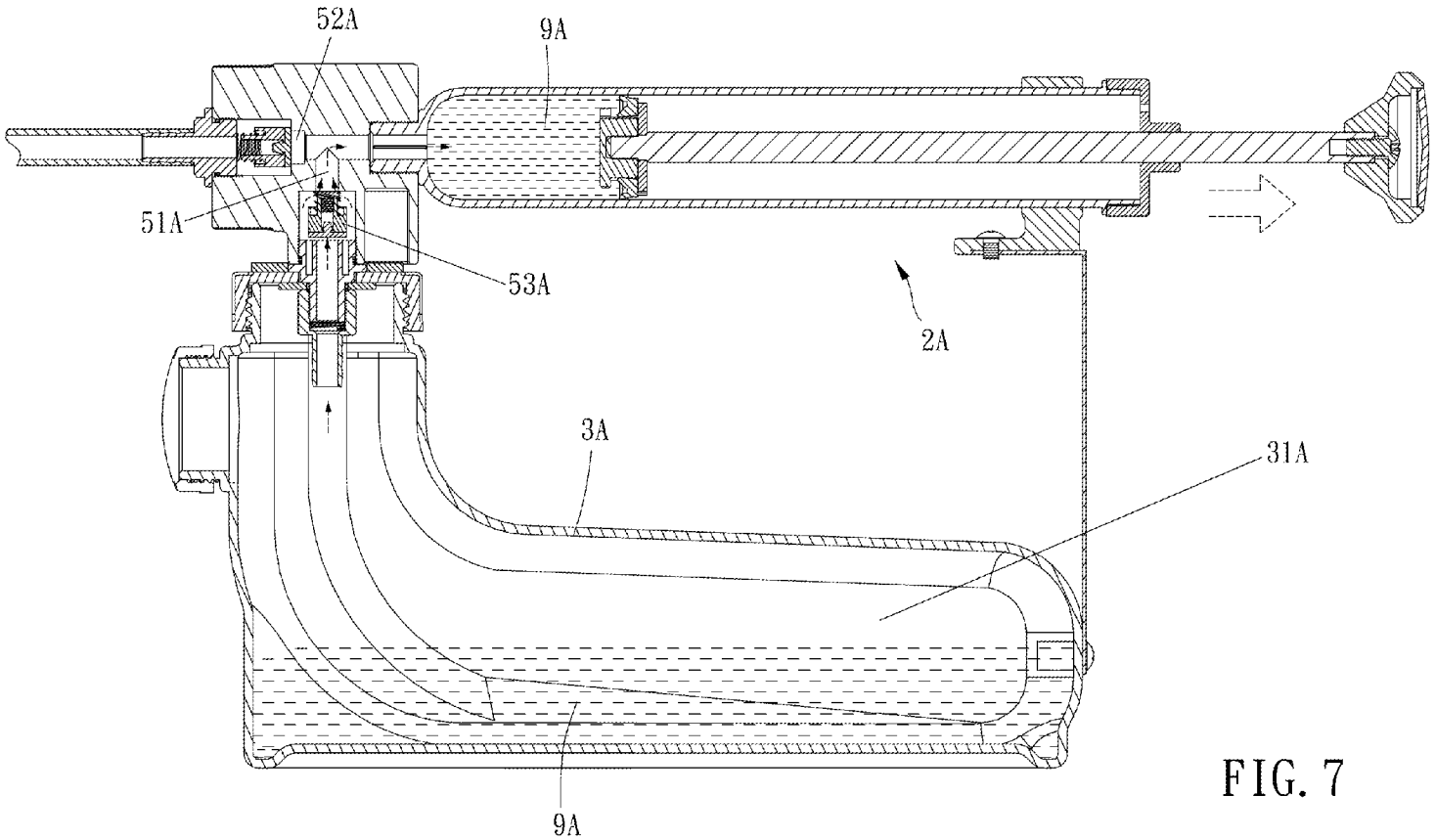
FIGS. 7 and 8 are drawings showing the second preferred embodiment of the present invention in use.
Figure 8:
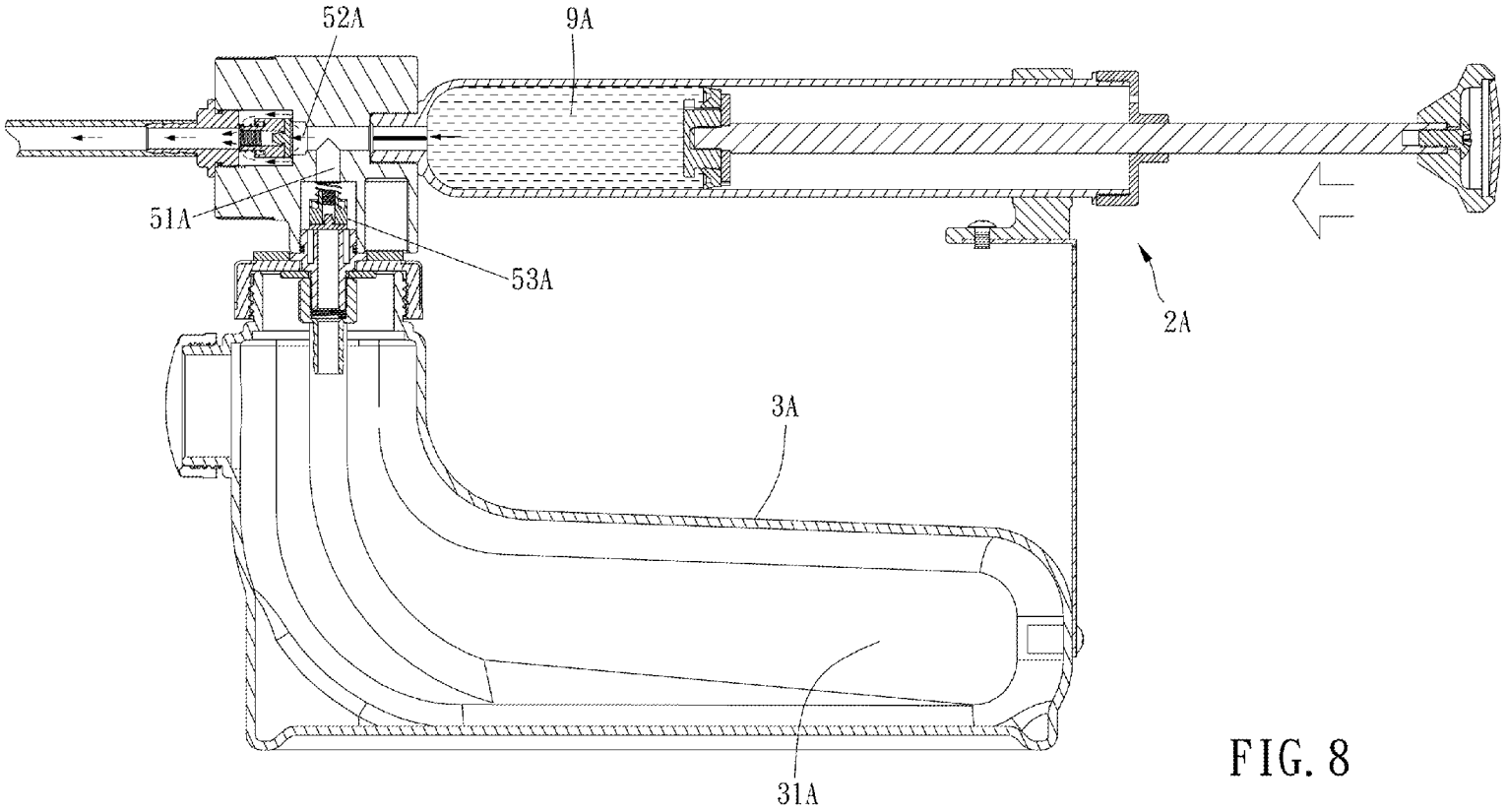

It is to be noted that the pumping device 1 of the first embodiment sucks the fluid 9 from outside into the receiving space 31. However, it is to be noted that a structure may be provided as a pumping device 1A of a second preferred embodiment as shown in FIGS. 6 to 8. The pumping device 1A includes a pumping unit 2A, a receiving unit 3A and a main body 5A. The pumping unit 2A is provided for being operated from outside to switch between a sucking state and a discharging state. The receiving unit 3A has a receiving space 31A for storing a fluid 9A. The main body 5A has a sucking channel 51A, a discharging channel 52A and at least one blocking mechanism 53A. The sucking channel 51A communicates with the receiving space 31A and an interior of the pumping unit 2A, the discharging channel 52A communicates with outside and the interior of the pumping unit 2A, and the blocking mechanism 53A is arranged in the sucking channel 51A to block the sucking channel 51A selectively. Wherein, when the pumping unit 2A is in the sucking state, the blocking mechanism 53A unblocks the sucking channel 51A, and the fluid enters the interior of the pumping unit 2A; when the pumping unit 2A is in the discharging state, the blocking mechanism 53A blocks the sucking channel 51A, and the fluid 9A flows to outside.

In other words, the fluid 9A in the second preferred embodiment is discharged to outside from the receiving space 31A, so the pumping device 1A can serve as an injector. In addition, the pumping device 1A of the second embodiment can cooperate with the pumping device 1 of the first embodiment. For example, when replacing oil in a machine, a user can suck out wasted oil in the machine via the pumping device 1 of the first embodiment, pull new oil into the pumping device 1A of the second embodiment, and pump the new oil into the machine. It is convenient and time-saving to replace oil in the machine with the pumping devices 1 and 1A.

Please further refer to the first embodiment as shown in FIGS. 1 to 5. Specifically, the pumping unit 2 includes a cylinder 21 communicating with the main body 5, a piston 22 and a rod 23. The cylinder 21 has a first end 211 connected with the main body 5 and a second end 212, and the second end 212 is formed with an axial hole 2121 and a circulation hole 2122 therethrough. The piston 22 is slidably disposed in the cylinder 21. An end of the rod 23 is connected with the piston 22, and the other end of the rod 23 is disposed through the axial hole 2121 and projects out of the cylinder 21 for being pushed or pulled; wherein, when the piston 22 moves toward the second end 212, the pumping unit 2 is in the sucking state, and the fluid 9 is sucked into the cylinder 21 through the sucking channel 51; when the piston 22 moves toward the first end 211, the pumping unit 2 is in the discharging state, and the piston 22 pushes the fluid 9 to enter the receiving space 31 through the discharging channel 52. However, it is noted that the pumping unit 2 is not limited thereto as long as the pumping unit 2 can suck and discharge a fluid. For example, the pumping unit 2 may be a power-drive tool to suck and discharge the fluid 9 through power.

More specifically, the receiving unit 3 has a storage barrel 32 and a connecting unit 4 connected with the main body 5 and the storage barrel 32. The storage barrel 32 is formed with the receiving space 31 and a first opening 321 which communicates with the discharging channel 52 and the receiving space 31; wherein, the storage barrel 32 is substantially L-shaped, a length of the storage barrel 32 on the second direction is substantially equal to a total length of the cylinder 21 and the main body 5 on the second direction, and a center of gravity C of the storage barrel 32 is lower than a half height D of the storage barrel 32; therefore, when the pumping device 1 is put on a place, the pumping device 1 does not shake easily. Preferably, the storage barrel 32 is further provided with a second opening 322 which communicates with outside and the receiving space 31 and a lid 33 which covers the second opening 322; therefore, when a user wants to discharge the fluid 9, s/he only needs to open the lid 33, and then the fluid 9 can be discharged from the second opening 322 without disengaging the storage barrel 32 from the main body 5. Wherein, the first opening 321 faces a first direction, the second opening 322 faces a second direction, the second direction is transverse to the first direction, and the second opening 322 is near the first opening 321. In addition, preferably, the storage barrel 32 includes at least one rubber layer to serve as a cushion when the pumping device 1 receives unexpected strike. Besides, preferably, the cylinder 21 or the storage barrel 32 may be formed with a see-through portion for the user to observe that the fluid 9 enters an interior of the cylinder 21 or the storage barrel 32.

The connecting unit 4 has a connecting member 41 covering the first opening 321 and a communicating assembly 42 connected with the discharging channel 52 and the connecting member 41, and the communicating assembly 42 communicates with the discharging channel 52 and the receiving space 31. Specifically, the communicating assembly 42 has a communicating member 421 pivoted to the connecting member 41, the communicating member 421 communicates with the discharging channel 52 and the receiving space 31, and the storage barrel 32 and the connecting member 41 are rotatable freely about the communicating member 421 relative to the main body 5; therefore, when in use, the storage barrel 32 can be rotated to avoid obstacles and be adjusted to any angle according to various requirements. Furthermore, the communicating assembly 42 of the first embodiment further has a blocking portion 4211 which is disposed around the communicating member 421 and a sleeve 422. An end of the communicating member 421 is connected with the discharging channel 52, and the other end of the communicating member 421 is disposed through the connecting member 41 and projects into the receiving space 31 to be connected with the sleeve 422 so that the connecting member 41 is rotatably sandwiched between the blocking portion 4211 and the sleeve 422. A metal pad is disposed respectively between the connecting member 41 and the blocking portion 4211 and between the connecting member 41 and the sleeve 422, so the storage barrel 32 can rotate smoothly. In addition, members mentioned above are detachably screwed to each other (for example, the cylinder 21 and the main body 5, the communicating member 421 and the discharging channel 52, and others), and it is easy to assemble or replace the members through screwing.

It is to be noted that preferably, the pumping device 1 further includes a positioning unit 6 abutting against the pumping unit 2, a sucking tube 7 and a discharging tube 8 disposed in the receiving space 31; wherein, the positioning unit 6 positioningly restrains relative positions of the pumping unit 2 and the receiving unit 3. In addition, preferably, the pumping unit 2, the main body 5, the receiving unit 3 and the positioning unit 6 define a gripping space H for a hand (not shown) to put therewithin so that the user can take and operate the pumping device 1 easily. Specifically, as viewed from a direction perpendicular to the first and second directions, the cylinder 21, the main body 5, the storage barrel 32 and the positioning unit 6 connected with each other continuously to form an enclosed contour and further define the gripping space H. More specifically, the positioning unit 6 has a supporting portion 61 extending along the first direction and a fixing member 62 connected with the supporting portion 61 and surrounding an annular side of the cylinder 21, and the supporting portion 61 is fixedly assembled to the storage barrel 32 relative to the second opening 322. As viewed from the second direction, the fixing member 62 is substantially O-shaped so that the cylinder 21 is detachably positioned by the fixing member 62. It is convenient to put away the fixing member 62, and the fixing member 62 can support the cylinder 21 stably when in use. It is understandable that in other embodiments, as viewed from the second direction, the fixing member 62 may be U-shaped and partially surround the annular side of the cylinder 21.

In addition, after the sucking tube 7 and the sucking channel 51 are communicably connected with each other, the pumping device 1 can enter an interior of an object which has a smaller opening or which is farther via the sucking tube 7. Furthermore, because an end of the discharging tube 8 is communicably connected with the sleeve 422, and the other end of the discharging tube 8 is near an inner wall of a bottom portion of the storage barrel 32; when the fluid 9 is a liquid, the discharging tube 8 can guide the liquid to accumulate from a bottom end of an interior of the storage barrel 32 to prevent the storage barrel 32 from shaking due to the liquid dripping down directly from an interior of the sleeve 422.

Given the above, the pumping device of the present invention is easy to be operated, and the fluid can be stored in the storage barrel for being taken to other places and processed.

In addition, the storage barrel is rotatable freely relative to the main body to avoid obstacles and to be used in a smaller space. When the receiving space is full, the second opening is provided for discharging the fluid directly.

Furthermore, the pumping device has a simple structure, so it is convenient and fast for the user to assemble the pumping device. Therefore, the pumping device can be manufactured in a large number in a short period of time to improve production efficiency.

While we have shown and described various embodiments in accordance with the present invention, it should be clear to those skilled in the art that further embodiments may be made without departing from the scope of the present invention.

What is claimed is:

1. A pumping device, including:

a pumping unit, provided for being operated from outside to switch between a sucking state and a discharging state;

a receiving unit, having a receiving space; and a main body, having a sucking channel for a fluid to enter thereinto, a discharging channel and at least one blocking mechanism, the sucking channel communicating with outside and an interior of the pumping unit, the discharging channel communicating with the receiving space and the interior of the pumping unit, one of the at least one blocking mechanism being arranged within the sucking channel to block the sucking channel selectively, wherein when the pumping unit is in the sucking state, the blocking mechanism unblocks the sucking channel, and the fluid enters the interior of the pumping unit; when the pumping unit is in the discharging state, the blocking mechanism blocks the sucking channel, and the fluid enters the receiving space, wherein the receiving unit has a storage barrel and a connecting unit which is connected between the main body and the storage barrel, the storage barrel is formed with the receiving space and a first opening which communicates with the discharging channel and the receiving space, wherein the connecting unit has a connecting member and a communicating assembly, the connecting member covers the first opening, the communicating assembly is connected with the discharging channel and the connecting member, and the communicating assembly communicates with the discharging channel and the receiving space, and wherein the communicating assembly has a communicating member pivoted to the connecting member, the communicating member communicates with the discharging channel and the receiving space, and the storage barrel and the connecting member are rotatable about the communicating member freely relative to the main body.

2. The pumping device of claim 1, wherein a center of gravity of the storage barrel is below half a height of the storage barrel.

3. The pumping device of claim 1, wherein the storage barrel is further provided with a second opening which communicates with the outside and the receiving space and a lid which covers the second opening.

4. The pumping device of claim 1, wherein the pumping unit includes a cylinder communicating with the main body, a piston and a rod, the cylinder has a first end which is connected with the main body and a second end, the second end is formed with an axial hole and a circulation hole, the piston is slidably disposed in the cylinder, an end of the rod is connected with the piston, an other end of the rod penetrates through the axial hole and projects out of the cylinder for being pushed or pulled; wherein when the piston moves toward the second end, the pumping unit is in the sucking state; when the piston moves toward the first end, the pumping unit is in the discharging state.

5. The pumping device of claim 1, wherein the main body has two said blocking mechanisms, the two blocking mechanisms are respectively a first unidirectional valve arranged in the sucking channel and a second unidirectional valve arranged in the discharging channel, the first unidirectional valve is only communicable from the sucking channel toward the pumping unit, and the second unidirectional valve is only communicable from the pumping unit toward the receiving space.

6. The pumping device of claim 1 further includes a positioning unit connected with the pumping unit, the positioning unit positioningly restraining relative positions of the pumping unit and the receiving unit.

7. The pumping device of claim 6, wherein the pumping unit, the main body, the receiving unit and the positioning unit form a gripping space for a hand to put therewithin.

8. The pumping device of claim 1, wherein the communicating assembly further includes a blocking portion disposed on the communicating member and a sleeve, an end of the communicating member is connected with the discharging channel, an other end of the communicating member is disposed through the connecting member and projects into the receiving space to be connected with the sleeve, and the connecting member is rotatably sandwiched between the blocking portion and the sleeve.

9. The pumping device of claim 8, wherein the storage barrel is further provided with a second opening communicating with the outside and the receiving space and a lid covering the second opening, the first opening faces a first direction, the second opening faces a second direction, the second direction is transverse to the first direction, the second opening is arranged neighboring to the first opening; the main body has two said blocking mechanisms, the two blocking mechanisms are respectively a first unidirectional valve arranged in the sucking channel and a second unidirectional valve arranged in the discharging channel, the first unidirectional valve is only communicable from the sucking channel toward the pumping unit, the second unidirectional valve is communicable from the pumping unit toward the receiving space; the pumping unit includes a cylinder which communicates with the main body, a piston and a rod, the cylinder has a first end which is connected with the main body and a second end, the second end is forming with an axial hole and a circulation hole, the piston is slidably disposed in the cylinder, an end of the rod is connected with the piston, an other end of the rod is disposed through the axial hole and projects out of the cylinder for being pushed or pulled, wherein when the piston moves toward the second end, the pumping unit is in the sucking state; when the piston moves toward the first end, the pumping unit is in the discharging state; the storage barrel is substantially L-shaped, a length of the storage barrel on the second direction is substantially equal to a total length of the cylinder and the main body on the second direction, a center of gravity of the storage barrel is below half of a height of the storage barrel; the pumping device further includes a positioning unit connected with the pumping unit, a sucking tube and a discharging tube arranged in the receiving space, the positioning unit positioningly restrains relative positions of the pumping unit, the receiving unit and the main body, the positioning unit has a supporting portion extending along the first direction, a fixing member connected with the supporting portion and surrounds an annular side of the cylinder, the supporting portion is fixedly assembled to the storage barrel opposite to the second opening, the cylinder is detachably positioned by the fixing member, as viewed from the second direction, the fixing member is substantially O-shaped; wherein as viewed from a direction perpendicular to the first and second directions, the cylinder, the main body, the storage barrel and the positioning unit form an enclosed contour and define a gripping space for a hand to put therewithin; the sucking tube and the sucking channel are communicably connected with each other, an end of the discharging tube is communicably connected with the sleeve, and an other end of the discharging tube is near an inner wall of a bottom portion of the storage barrel.

* * * * *